US005452589A

United States Patent [19]

Carter

[11] Patent Number: 5,452,589

[45] Date of Patent: Sep. 26, 1995

[54] FACE DECORATION AND METHOD OF USING SAME

[76] Inventor: Mary J. Carter, 315 Surrey Dr., Bonita, Calif. 91902

[21] Appl. No.: 202,347

[22] Filed: Feb. 28, 1994

Related U.S. Application Data

[62] Division of Ser. No. 91,778, Jul. 14, 1993, Pat. No.5,363, 675.

[51] Int. Cl.[6] ..... A44C 7/00

[52] U.S. Cl. ..... 63/14.1; 63/14.2

[58] Field of Search ..... 63/2, 12, 1, 14.8

[56] References Cited

U.S. PATENT DOCUMENTS

| | | | |
|---|---|---|---|
| 468,883 | 2/1892 | Masters | 63/14.2 |
| 2,409,369 | 10/1946 | LoCurto | 63/14.2 |
| 2,414,382 | 1/1947 | McCann | 63/14.2 |
| 2,502,386 | 3/1950 | Mailand | 63/14.2 |
| 5,184,482 | 2/1993 | Cloud | 63/14.1 |

*Primary Examiner*—Flemming Saether
*Attorney, Agent, or Firm*—Bernard L. Kleinke; Peter P. Scott

[57] ABSTRACT

A face decoration, and a method of using it, includes a main ornamentation body for positioning on the face area of a user adjacent to and partially engaging the tragus portion of the ear. An upper ear attachment comprising flexible pliable wire secures the upper portion of the main ornamentation body to the upper pinna portion of the ear by being readily bent to fit into an upper groove in the back of the ear between the upper pinna ear portion and the adjacent portion of the head. An upper rear ornamentation device is fixed to the distal end portion of the upper ear attachment so that the distal end portion can be bent upwardly away from the ear groove to position the ear ornamentation device in back of the ear, in a suitable manner for viewing purposes. The upper rear ornamentation can be extended to project from behind the ear to adorn the area adjacent to the ear. A lower ear attachment having a flexible pliable wire secures the bottom portion of the main ornamentation body to the lower pinna portion of the ear, by being readily bent to fit into a lower groove in the back of the ear between the lower pinna ear portion and the adjacent portion of the head. A lower rear ornamentation device is fixed to the distal end portion of the lower wire for additional ornamentation. The distal wire end is bent downwardly and away from the lower groove to position the lower ear ornamentation device in the back of the ear. The lower rear ornamentation projects from behind the ear in a manner similar to the upper rear ornamentation.

6 Claims, 2 Drawing Sheets

Fig. 1
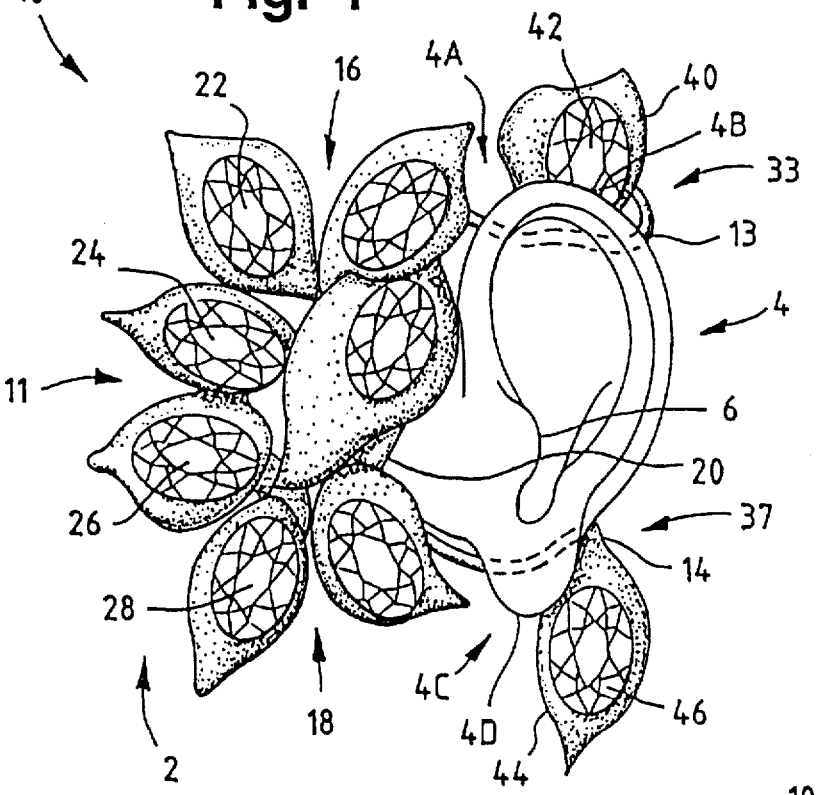
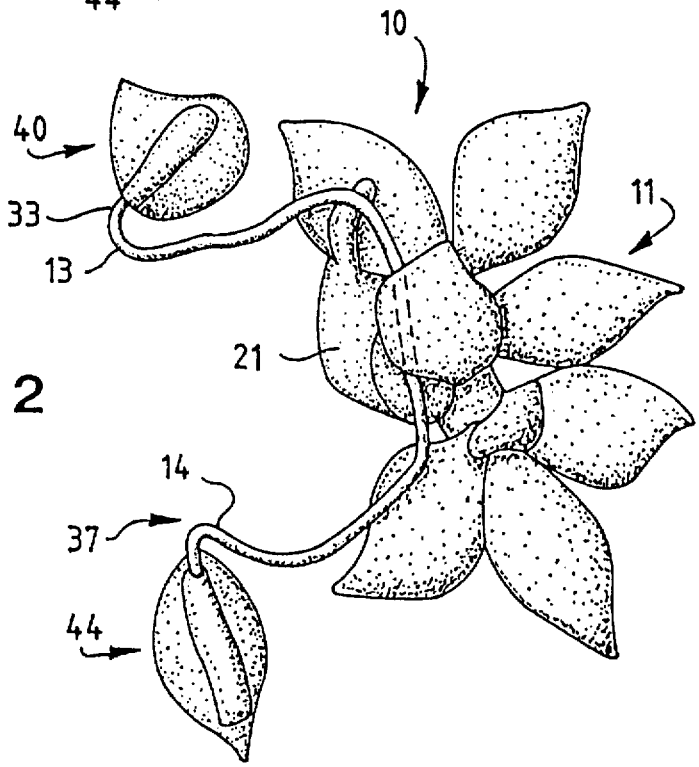
Fig. 2

FACE DECORATION AND METHOD OF USING SAME

This is a division of application Ser. No. 08/091,778, filed on Jul. 14, 1993, now U.S. Pat. No. 5,363,675.

TECHNICAL FIELD

The present invention relates in general to a decoration for a face, and a method of using the decoration. The invention more particularly relates to such a decoration worn on the face and in front of the ear.

BACKGROUND ART

Decorating the human face in the past has involved techniques such as the application of colored pigments to the skin in desired arrangements. These techniques require a large expenditure of time, both in applying the decoration and in removing the decoration. In the case of a tatoo, the decoration is semi-permanent and requires a surgical like procedure for removal. Thus, these techniques are not suitable for the person who wishes to apply or remove a decoration in an easy manner.

Various decorations have been contemplated which attach to the ear with little effort and provide the ear with ornamentation. Examples of such decorations, though considered less pertinent as they are not facial decorations, include U.S. Pat. Nos. 89,452; 236,935; 2,409,369; 2,453,485; 2,498,748; 2,502,386; 2,526,087; 3,958,430; 4,282,721; and 4,827,738.

U.S. Pat. No. 4,803,853 discloses an ornamental ear insert which is adapted to be inserted and retained in the external ear. A resilient metal mesh screen having folds throughout and a hook at its upper and lower portions permit the ornamental ear insert to be secured to the ear. In use, the mesh screen is compressed and inserted into the external ear, concealing the ear canal. When released, the mesh screen expands and presses against the external ear, thereby securing the ornamental ear insert. For additional fastening purposes, the hooks are placed between the external ear and the skull. The hooks bend into the outer portion of the external ear to prevent the upper and lower portions of the ornamental ear insert from being displaced.

Although the above described ornamental ear insert attaches easily, it does not provide ornamentation for the face. Such an ornament is limited to placement within the ear. The expansion property of the mesh screen is ineffective outside of the ear as there are no features on the face which the mesh screen can expand against. Thus, it would be highly desirable to have a facial decoration which may be easily attached and removed. Such a decoration should be supported by the ear and should rest on the face in a position forward of the ear.

A technique which provides an adornment in the form of an earring, which can be applied or removed with relative ease, is described in U.S. Pat. No. 4,993,240. There, a hook or J-shaped rigid bar or strip is placed behind the ear and an end leg portion of the J-shaped strip is secured to the pierced earlobe by an earring stud and bracket. Connected to the curved upper portion of the J-shaped strip is a decorative member extending downwardly in front of the ear. There is a provision for adjusting the size of the strip to accommodate different sized ears. In this regard, the end leg portion is adapted to receive the earring stud in different openings in the strip wherein the stud is held in position by the bracket.

While such an arrangement may be adapted to fit various ear sizes, it requires the strip to be in contact with the back portion of the ear in at least two different locations. In this regard, the strip contacts the back portion of the ear at the ear lobe and at the top of the ear where the adornment extends in front of the ear. Depending on the shape of the ear, another contact area may exist. For example, where the radius of curvature of the rear portion of the ear is less than that of the decorative member, the strip will contact an intermediate portion of the rear portion of the ear. Such extensive contact with the ear can result, under certain circumstances, in discomfort to the wearer due to pressure exerted against the ear by the strip.

Where the strip contacts the ear at the intermediate portion and the top of the ear, the discomfort results from the sensitivity of the soft skin on the rear portion of the ear. The strip contacts the soft skin along a discrete line of engagement at the two aforementioned locations. Thus, the force exerted by the strip on the soft skin of the rear portion of the ear is concentrated at two areas. The result of the concentrated forces is an indentation in the skin which is translated into discomfort, and even pain, for the user.

Further discomfort is realized by the user where the strip is permitted to move along the surface of the soft skin. As the curved upper portion of the J-shaped strip merely rests on the top of the ear, the strip is free to rotate about the earring stud. When the strip does rotate, for example, when the wearer is dancing, the strip will rub against the soft skin of the ear at the intermediate portion and at the top of the ear. The rubbing of those two locations results in discomfort and may lead to abrasions from the frictional forces between the strip and the soft skin.

The use of an earring to support the strip at the ear lobe adds to the discomfort of the user. Substantially all of the mass of the ear decoration is located above the point where the earring stud connects the strip to the ear lobe. Thus, the ear lobe must support the strip, counteracting the downward force exerted by gravity. As the ear lobe is relatively small and thin, the downward force is not well dispersed and results in a concentrated pressure point causing discomfort.

A user may object to the use of an earring attachment for reasons other than those of discomfort. For instance, a question of hygiene is presented to a user wanting pierced ears. If the user chooses not to have pierced ears, for whatever reason, the use of a decoration having an earring support is not possible. Furthermore, the user may object to the appearance of non-aesthetically pleasing components of the decoration.

The decoration of U.S. Pat. No. 4,993,240 is adaptable to different sizes of ears. All that is required to adjust the size of the decoration is to select a new opening in which to insert the ear stud. A large ear size requires the ear stud to be placed in an opening farthest from the top of the ear while a small ear size requires the ear stud to be placed in an opening closer to the top of the ear than for a large ear. In the case of a small ear, the appropriate opening is selected, leaving a portion of the strip to extend down below the ear lobe. The portion which extends down contains unused openings and detracts from the appearance of the decoration.

Another drawback to the decoration described above is the manner in which the user puts on the decoration. Although applying and removing the decoration can be done without special tools, unlike a tatoo, it is at best an awkward procedure. The user must perform a number of operations simultaneously in order to be successful. The strip must be held so that the openings in the end leg portion are aligned with the hole in the ear lobe. The bracket must be placed and held behind the appropriate hole. Additionally, the earring stud must be aligned with the hole in the ear lobe as well.

To accomplish all of the above at the same time would seem to require four hands, even under the best of conditions. Under some conditions, such as in a dimly lit room, in an automobile, or without the benefit of a mirror, such a task would seem extraordinarily awkward, no matter how many hands were available.

Thus, it would be highly desirable to have a facial decoration which is constructed and arranged such that it engages the ear from the front and, therefore, requires only minimal contact with the ear at its upper and lower parts to support the decoration.

Such a device should be capable of being adjusted readily to various ear sizes without adding excessive weight to the decoration or adding unappealing obtrusive support members. Furthermore, such a device should provide additional decoration behind the ear to further enhance the aesthetic appearance of the ear.

DISCLOSURE OF INVENTION

Therefore, it is a principal object of the present invention to provide a new and improved face decoration, and method of using it, wherein the decoration is worn on the face in front of the ear in a secure manner such that wearer does not suffer discomfort from excessive contact between the support assembly and the back of the ear.

Another object of the present invention is to provide such a new and improved face decoration, and method of using it, that is adaptable for use by many people having a variety of ear sizes and that does not require a conspicuous support assembly and which provides supplementary ornamentation behind the ear.

Briefly, the above and further objects and features of the present invention are realized by providing a face decoration, and a method of using it. The decoration includes a main ornamentation body for positioning on the face area of a user adjacent to and partially engaging the tragus portion of the ear. An upper ear attachment having a flexible pliable wire secures the upper portion of the main ornamentation body to the upper pinna portion of the ear by being readily bent to fit into an upper groove in the back of the ear between the upper pinna ear portion and the adjacent portion of the head. An upper rear ornamentation device is fixed to the distal end portion of the upper ear attachment so that the distal end portion can be bent upwardly away from the ear groove to position the ear ornamentation device in back of the ear, in a suitable manner for viewing purposes. Thus, the upper rear ornamentation can be extended to project from behind the ear to adorn the area adjacent to the ear.

A lower ear attachment having another flexible pliable wire secures the bottom portion of the main ornamentation body to the lower pinna portion of the ear, by being readily bent to fit into a lower groove in the back of the ear between the lower pinna ear portion and the adjacent portion of the head. A lower rear ornamentation device is fixed to the distal end portion of the lower ear attachment for additional ornamentation. The distal end portion is bent downwardly and away from the lower groove to position the lower rear ornamentation device in back of the ear. In this way, the lower rear ornamentation projects from behind the ear in a manner similar to the upper rear ornamentation.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein:

FIG. 1 is a front elevational view of a face decoration which is constructed in accordance with the present invention, and which is shown attached in place at the ear of the wearer;

FIG. 2 is a rear elevational view of the face decoration of FIG. 1, illustrating it removed from the wearer;

BEST MODE FOR CARRYING OUT THE INVENTION

Figure 3:
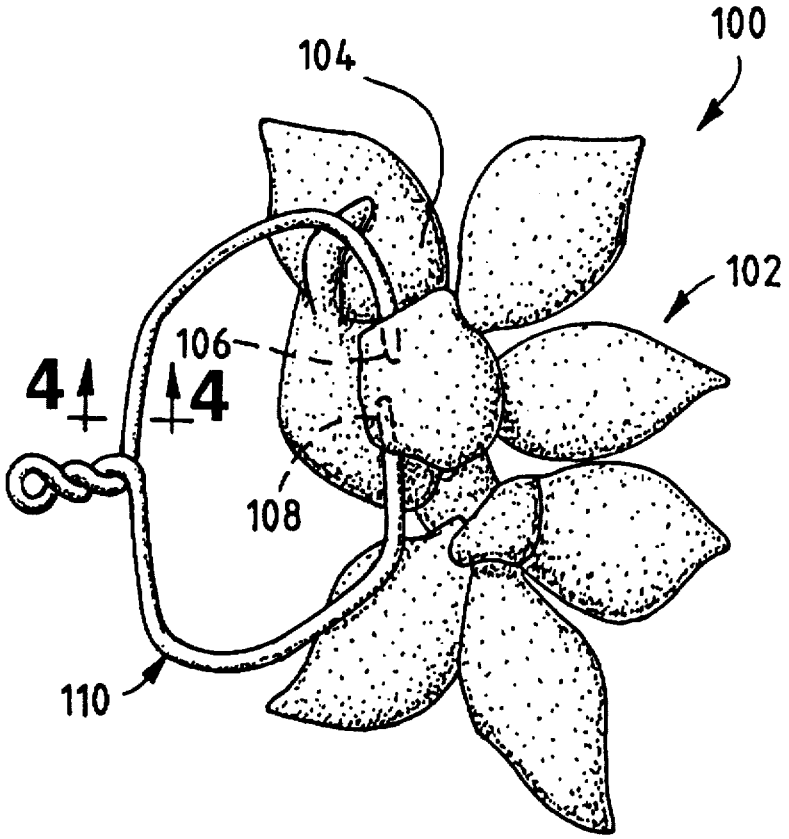
FIG. 3 is a rear elevational view of another face decoration which is also constructed in accordance with the present invention, illustrating it removed from the wearer.

Referring now to the drawings, and more particularly to FIG. 1 thereof, there is shown a face decoration 10 which is constructed according to the present invention. The decoration 10 is worn on a side face portion 2 of a user and is held in position through engagement with upper and lower ear portions of the user, such as an upper ear portion 4A and a lower ear portion 4C. It should be understood that another like face decoration (not shown) may also be used with the decoration 10 so that both sides of the face can be adorned.

The face decoration 10 generally includes an elongated face decoration body portion 11 having an ornamental design for enhancing the facial appearance of the user. In this regard, as will be explained hereinafter in greater detail, the body portion 11 is adorned with jewels, rhinestones, pearls and other similar decorative items such as ornaments 22, 24, 26 and 28. A pair of ear attachment devices 13, 14 having distal end portions 33, 37 are connected to upper and lower portions 16, 18 of the body portion 11, respectively, for supporting it from the upper and lower ear portions 4A, 4C of the user. Upper ear ornament arrangement 40 and lower ear ornament arrangement 44 are attached to the distal end portions 33, 37, respectively, for decorating the area adjacent to the upper ear portion 4A and lower ear portion 4C.

In wearing the decoration 10, the decoration 10 is placed on the side face portion 2 of the user in the vicinity of the ear 4 with the ear attachment devices 13 and 14 extending rearwardly from the body portion 11 toward the back of the head of the user. The ear attachment devices 13 and 14 are then adjusted individually to fit around the upper and lower ear portions 4A and 4C, respectively, to secure the body portion 11 on the face generally indicated at 2. In this regard, the body portion 11 is secured on the face 2 forward of and immediately adjacent to a tragus 6 portion of the ear 4. Once the body portion 11 has been secured to the face 2, the distal end portions 33, 37 are adjusted to extend away from the ear 4 so that the additional ornamentation of arrangements 40 and 44 is visible, thus providing supplementary decoration behind the respective upper and lower ear portions 4A and 4C of the user.

Considering now the facial decoration 10 in greater detail, the body portion 11 generally includes a base member 20 to retain the ornaments 22, 24, 26 and 28 in a stationary position. The base member 20 is elongated and includes a smooth inner surface 21 for resting comfortably on the face 2 and an outer surface 23 which is shaped and sized to accommodate one or more ornaments, such as the ornaments 22, 24, 26, and 28. Ornaments 22 , 24, 26, and 28 are attached securely to the outer surface 23 by a conventional method, such as gluing.

Considering now the ear attachment devices 13 and 14 in greater detail with reference to FIGS. 1 and 2, the upper ear attachment device 13 is connected to an upper portion 16 of the body portion 11 and extends substantially rearwardly therefrom, leaving distal end portion 33 free to be positioned as required by the user. The device 13 generally engages the upper ear portion 4A at an upper portion (not shown) of an outer groove (not shown) formed by the intersection of the head with an upper pinna portion 4B of the ear 4 to provide support for the decoration 10.

The lower ear attachment device 14 is connected to a lower portion 18 of the body 11 and extends substantially rearwardly therefrom, leaving distal end portion 37 free to be positioned by user. The lower device 14 engages the lower ear portion 4C at a lower portion (not shown) of the outer groove formed by the intersection of the head with a lower pinna portion 4D of the ear 4 for providing the decoration 10 with additional support, thus preventing disengagement of the body portion 11 from the face of the user.

The upper device 13 and lower device 14 are preferably made of flexible pliable wire, to aid in the adjustment of the upper and lower devices 13, 14 to facilitate easy attachment or removal of the decoration 10 and for permitting distal end portions 33 and 37 to be positioned as required. Such a configuration also accommodates different ear sizes.

In operation, the upper attachment device 13 is positioned adjacent to the upper ear portion 4A and lower attachment device 14 is positioned adjacent to lower ear portion 4C. Then, the medial portion of the upper device 13 is contorted to conform to the upper groove portion and the medial portion of lower device 14 is similarly contorted to conform to the lower groove portion, thereby securing the body portion 11 on the face of the user in front of the tragus 6.

Considering now the upper ear ornament arrangement 40 and the lower ear ornament arrangement 44 in greater detail with reference to FIGS. 1 and 2, both arrangements 40 and 44 are preferably made of a lightweight material such as plastic and each is sized and shaped to hold at least one ornament, such as ornaments 42 and 46 respectively. Arrangement 40 is connected to distal end portion 33 while arrangement 44 is connected to distal end portion 37 to provide additional ornamentation at the distal portions 33 and 37.

Once the decoration 10 is positioned on the face and the body portion 11 is properly secured, the distal end portions 33 and 37 are deflected away from the outer groove. Thus, the ornament arrangements 40 and 44 may be bent into a desired position behind and adjacent to the ear 4 where they may be observed. In this way, the ear 4, as well as the face 2, is provided with embellishment for aesthetically pleasing results.

Figure 4:
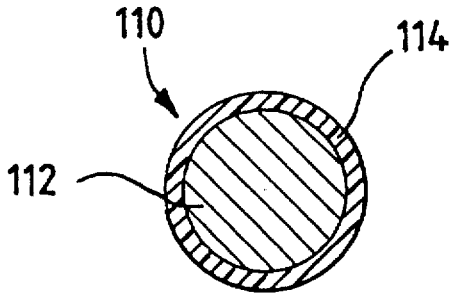
FIG. 4 is an enlarged cross section of the face decoration of FIG. 3 taken along line 4—4.

Referring now to FIGS. 3 and 4, there is shown another face decoration 100, which is also constructed according to the invention. Face decoration 100 is similar to face decoration 10 except that face decoration 100 attaches to an ear with a single flexible pliable wire member 110 rather than a pair of wires, such as wires 13 and 14 (FIGS. 1 and 2). Face decoration 100 further includes a main body 102 having an inner surface 104 to engage a face of a user. Ornamentation (not shown) is attached to the front side (not shown) of the main body 102 to enhance the appearance of the user.

Distal ends 106 and 108 of wire member 110 are brought together, forming an annular shaped closed loop configuration, and connected to inner surface 104. As best seen in FIG. 4, wire member 110 includes an inner wire 112 surrounded by an outer plastic coating 114. Plastic coating 114 may be colored as desired to enhance the aesthetic appearance of the decoration 100 and for the comfort of the wearer.

In use, the decoration 100 is positioned near the ear with the body 102 just forward of the ear and inner surface 104 next to the face. Wire member 110 is slipped over the ear and adjusted to fit snugly within the groove formed by the intersection of the head and the ear.

Adjustment of wire member 110 is accomplished by grasping wire member 110 from behind the ear and twisting wire member 110 as required, thereby reducing the size of the annular shaped configuration. In this way, the wire member 110 can be twisted until the decoration 100 is secured releasably to the ear, to accommodate various different sizes and shapes of ears.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A face decoration worn adjacent to an ear of a user, comprising:

face engageable means having an ornamental design for enhancing the appearance of the user;

upper pinna attachment means having a free distal end portion, said upper pinna attachment means being connected to an upper portion of said face engageable means for supporting it from an upper pinna ear portion of the user, said upper pinna attachment means also having a flexible pliable wire being readily bent to conform to an outer groove formed by the intersection of said upper pinna ear portion and the head;

said upper pinna attachment means attachment means having a distal end ornament means for decorating an area adjacent to said upper pinna ear portion, wherein said free distal end portion being bendable upwardly away from said outer groove to position said distal end ornament means rearward of said upper pinna ear portion;

lower pinna attachment means having another free distal end portion, said lower pinna attachment means being connected to a lower portion of said face engageable means for supporting it from a lower pinna ear portion of the user, said lower pinna attachment means having another flexible pliable wire being readily bent to conform to another outer groove formed by the intersection of said lower pinna ear portion and the head;

said lower pinna attachment means having another distal end ornament means for decorating an area adjacent to said lower pinna ear portion, wherein said other free distal end portion being bendable downwardly away from said outer groove to position said distal end ornament means rearward of said lower pinna ear portion; and wherein said face engageable means is secured substantially forward of a tragus portion of the ear.

2. A face decoration according to claim 1, wherein said face engageable means includes a body portion.

3. A face decoration according to claim 2, wherein said body portion includes a plurality of ornaments.

4. A face decoration according to claim 1, wherein said distal end ornament means of said upper pinna attachment means includes at least one ornament.

5. A face decoration according to claim 1, wherein said another distal end ornament means of said lower pinna attachment means includes at least one ornament.

6. A method of using a face decoration on a user, comprising:

using a face engageable means having an ornamental design for enhancing the appearance of the user, said face engageable means having upper and lower pinna attachment means connected to said face engageable means for supporting it from upper and lower pinna ear portions of the user, said upper and lower pinna attachment means having a pair of respective flexible pliable wires being readily bent to conform to an outer groove formed by the intersection of said upper pinna ear portion and the head;

bending an intermediate portion of the wire to conform to said outer groove;

bending a free distal end of the upper pinna attachment means upwardly away from said outer groove to position said distal end ornament means rearward of said upper pinna ear portion to adorn an upper area behind the ear using said upper pinna attachment means further having a distal end ornament means to decorate an area adjacent to said upper pinna ear portion;

bending another flexible pliable wire of said lower pinna attachment means to conform to another outer groove formed by the intersection of said lower pinna ear portion and the head;

bending an intermediate portion of said other wire to conform to said other groove;

bending downwardly the free distal end of the lower pinna attachment means away from said other groove to position said distal end ornament means rearward of said lower pinna ear portion to adorn a lower area behind the ear using said lower pinna attachment means further having another distal end ornament means for decorating an area adjacent to said lower pinna ear portion;

whereby said face engageable means is secured substantially forward of a tragus portion of the ear.

* * * * *

UNITED STATES PATENT AND TRADEMARK OFFICE

CERTIFICATE OF CORRECTION

PATENT NO. : 5,452,589
DATED : September 26, 1995
INVENTOR(S) : Mary J. Carter

It is certified that error appears in the above-indentified patent and that said Letters Patent is hereby corrected as shown below:

Column 8, line 16, delete "other", and substitute therefor --outer--.

Signed and Sealed this

Tenth Day of December, 1996

*Attest:*

*Attesting Officer*

BRUCE LEHMAN

*Commissioner of Patents and Trademarks*